US008978937B2

(12) United States Patent
Chambers et al.

(10) Patent No.: US 8,978,937 B2
(45) Date of Patent: Mar. 17, 2015

(54) ACTUATOR FOR AN AEROSOL CONTAINER

(75) Inventors: Richard Chambers, Leeds (GB); Andrew Fielding, Leeds (GB); Adam William Peacock, Neston (GB); Graham Paul Randall, Wirral (GB); James Edward Roe, Glossop (GB); Jason Peter Roebuck, Hyde (GB); Kevin John Stamp, Ellesmere Port (GB)

(73) Assignee: Conopco Inc., Englewood Cliffs, NJ (US)

( * ) Notice: Subject to any disclaimer, the term of this patent is extended or adjusted under 35 U.S.C. 154(b) by 109 days.

(21) Appl. No.: 13/695,067

(22) PCT Filed: Apr. 21, 2011

(86) PCT No.: PCT/EP2011/056469
§ 371 (c)(1),
(2), (4) Date: Feb. 21, 2013

(87) PCT Pub. No.: WO2011/138186
PCT Pub. Date: Nov. 10, 2011

(65) Prior Publication Data

US 2013/0140329 A1 Jun. 6, 2013

(30) Foreign Application Priority Data

May 5, 2010 (EP) ..... 10162049

(51) Int. Cl.
*B65D 83/00* (2006.01)
*B65D 83/22* (2006.01)
*B65D 83/20* (2006.01)

(52) U.S. Cl.
CPC ..... *B65D 83/22* (2013.01); *B65D 83/205* (2013.01); *B65D 83/222* (2013.01); *B65D 2215/04* (2013.01)
USPC ..... 222/402.13; 222/153.11; 222/402.1; 222/402.11

(58) Field of Classification Search
CPC .... B65D 83/205; B65D 83/206; B65D 83/48; B65D 83/20; B65D 77/065; B65D 83/222; B65D 83/384; B65D 83/22
USPC ..... 222/402.1, 402.13, 402.11, 402.23, 222/153.1, 153.11, 153.13, 182
See application file for complete search history.

(56) References Cited

U.S. PATENT DOCUMENTS 2,678,147 A 5/1954 Abplanalp
3,076,609 A 2/1963 Stocker (Continued)

FOREIGN PATENT DOCUMENTS

EP 0613836 A1 9/1994
EP 0693439 A1 1/1996

(Continued)

OTHER PUBLICATIONS

Search Report Chinese Application No. 201180022579.6 dated Apr. 21, 2011 (Translation).

(Continued)

*Primary Examiner* — Frederick C Nicolas
(74) *Attorney, Agent, or Firm* — Ronald A. Koatz

(57) ABSTRACT

An actuator (1) for a hand-held aerosol container fitted centrally at its top with a dispensing valve, the actuator having: (i) a cup-shaped over-cap (3) attachable to the container and having a top wall defining a gap through which a spray channel passes, the gap restricting lateral movement of the spray channel; (ii) a spray channel (4) in fluid connection with the valve; (iii) an actuator button (5) having a finger pad from which a keel depends; the keel dependent from the finger pad of the button (5) being able to press down onto the spray channel (4) and the spray channel (4) on to the valve after the first slide movement of the button (5), but not before; whereby the actuator button (5) has a distinct first slide movement that puts it into an orientation in which a second depression movement causes release of the contents of the associated dispenser and in that the force required for the first slide movement of the actuator button (5) is at least 5N.

9 Claims, 7 Drawing Sheets

Section A-A

(56) References Cited

U.S. PATENT DOCUMENTS

| | | | | |
|---|---|---|---|---|
| 3,169,672 | A | 2/1965 | Soffer | |
| 3,185,349 | A | 5/1965 | Sagarin | |
| 3,494,510 | A | 2/1970 | Rahn | |
| 3,734,353 | A | 5/1973 | McIlhenny | |
| 3,967,760 | A | 7/1976 | Marcon | |
| 4,325,497 | A | 4/1982 | Ewald | |
| 5,368,231 | A | 11/1994 | Brunerie | |
| 6,161,736 | A | 12/2000 | Kaufman et al. | |
| D447,948 | S | 9/2001 | Pannozzo et al. | |
| 6,398,082 | B2 | 6/2002 | Clark | |
| 6,454,139 | B1 | 9/2002 | Bayer | |
| 6,510,967 | B1 | 1/2003 | DeSimone | |
| D490,699 | S | 6/2004 | Nelson et al. | |
| 6,817,493 | B1 | 11/2004 | Parsons et al. | |
| 6,820,823 | B2 | 11/2004 | Parsons et al. | |
| 7,028,866 | B2 | 4/2006 | Kunesh et al. | |
| 7,104,427 | B2 | 9/2006 | Pericard et al. | |
| 7,721,920 | B2 | 5/2010 | Ruiz De Gopegui et al. | |
| 7,854,356 | B2 * | 12/2010 | Eberhardt | 222/402.13 |
| 2003/0129142 | A1 | 7/2003 | Schroeder | |
| 2004/0149781 | A1 | 8/2004 | Kunesh et al. | |
| 2004/0164103 | A1 | 8/2004 | Uemura et al. | |
| 2005/0242101 | A1 | 11/2005 | Skalitzky | |
| 2012/0037668 | A1 * | 2/2012 | Bicknell et al. | 222/402.13 |
| 2013/0320041 | A1 * | 12/2013 | Selinger et al. | 222/153.11 |

FOREIGN PATENT DOCUMENTS

| | | | |
|---|---|---|---|
| EP | 0693439 | B1 | 10/2001 |
| FR | 2267004 | | 10/1975 |
| FR | 2267004 | A7 | 10/1975 |
| WO | WO2007112310 | A2 | 10/2007 |
| WO | WO2010052168 | A1 | 5/2010 |

OTHER PUBLICATIONS

AERODynamics, BAMA (British Aerosol Manufacturers's Association), Mar. 27, 2008, vol. 7, pp. 1-4.

Nivea Product Lines, Alpine Village Cosmetics, Dec. 14, 2008, pp. 1-7.

PCT International Search Report in PCT application PCT/EP2011/056469 dated May 26, 2011 with Written Opinion.

European Search Report in EP application EP 10 16 2053 dated Jul. 19, 2010.

Co-pending Application: Applicant: Bicknell et al., U.S. Appl. No. 13/127,251, filed Oct. 29, 2009.

PCT International Search Report in PCT application PCT/EP2009/064314 dated Feb. 3, 2010 with Written Opinion.

European Search Report in EP application EP 08 16 8360 dated Mar. 27, 2009.

* cited by examiner

Section A-A

Section B-B

Section C-C

ACTUATOR FOR AN AEROSOL CONTAINER

FIELD OF INVENTION

The present invention relates to an actuator for an aerosol container, in particular an aerosol container holding a cosmetic composition, and the use of such actuators for the release of the contents of said container. The invention is especially concerned with actuators having an actuator button requiring independent slide movement and depression to achieve activation.

BACKGROUND

Certain aerosol actuators having good ergonomics have been designed with actuator buttons that have a sliding movement.

U.S. Pat. No. 6,398,082 discloses an actuating mechanism for a hand held canister in which a slider is moveable by finger pressure from a valve-disengaged position into a valve-engageable position and a concealed spring returns the slider to a valve-disengaged position when finger pressure is removed.

U.S. Pat. No. 2,678,147 discloses a slider fitting over an actuator having a base profile which rests on a shoulder surrounding a plunger in an inoperable position and which is slid forwards to an operable position in which the slider base rests on the plunger and is spaced above the shoulder allowing depression of the slider.

U.S. Pat. No. 3,734,353 discloses an actuator in which a button is slid forward beyond the edge of the tab and over an aerosol valve, so that the button can be depressed.

U.S. Pat. No. 4,325,497 discloses an actuator which is child-resistant in which an actuator button is simultaneously slid forward and downward to actuate the device and is returned to its original position by a spring arrangement.

WO 2010/052168, published on 14.05.10 and claiming priority dates of May 11, 2008 and Mar. 7, 2009, discloses a hand held aerosol dispenser comprising an actuator sharing some common features with that of the present invention, but lacking independent slide movement and depression of an actuator button to achieve activation, particularly with the slide movement requiring significant force.

US 2004/0164103 discloses a cap for mounting on an aerosol container that enables automatic release of residual propellant from the container before it is discarded.

U.S. Pat. No. 2,678,147 discloses foam dispenser head for an aerosol dispenser having actuator button that requires sliding forwarding before it can be depressed.

General Description

An object of the present invention is to provide an actuator for an aerosol dispenser that has good ergonomics and robustness of operation. A key feature of the robustness of operation is the avoidance of lateral pressure upon the dispensing valve and more specifically the valve stem of the aerosol container upon which the actuator is used.

A further object of the present invention is to provide an actuator for an aerosol dispenser that has good resistance to premature discharge, that is to say, good resistance to release of the dispenser's contents before desired; for example, during manufacture or transit.

A further object of the present invention is to provide an actuator for an aerosol dispenser that has good ergonomics and robustness of operation.

A feature of the invention that aids the resistance to premature discharge is an actuator button that requires significant force to move it to a position in which it is operable. It is essential that this first movement is independent of the movement that causes release of the contents of the aerosol dispenser.

In a first aspect of the present invention, there is provided an actuator for a hand-held aerosol container fitted centrally at its top with a dispensing valve, said actuator comprising:

(i). a cup-shaped over-cap attachable to the container and comprising a sidewall defining a spray aperture through which a spray can be directed and a top wall defining a gap through which the spray channel passes, said gap restricting lateral movement of the spray channel;

(ii). a spray channel in fluid connection with the valve and adapted to spray through the spray aperture in the sidewall of the over-cap;

(iii). an actuator button comprising a finger pad from which a keel depends; actuation requiring a first slide movement of the button and second depression movement of the button, the keel dependent from the finger pad of the button being able to press down onto the spray channel and the spray channel on to the valve after the first slide movement of the button, but not before; characterised in that:

the actuator button has a distinct first slide movement that puts it into an orientation in which an independent second depression movement causes release of the contents of the associated dispenser and in that the force required for the first slide movement of the actuator button is at least 5N.

In a second aspect of the present invention, there is provided a method of applying a cosmetic aerosol composition to the human body comprising the use of an actuator according to the first or second aspect of the invention.

DETAILED DESCRIPTION

Throughout this description, orientation terms such as "top", "upper", "vertical", and "horizontal" should be understood to be referring to the actuator in its "in use" position sat on top of an upright aerosol container as illustrated in FIG. 1.

The term "depend" should be understood to refer to features that project downwards from others.

The term "lateral" should be understood to refer to the plane approximately orthogonal to the vertical axis of the actuator when oriented as described in the paragraph before last.

The actuator's vertical axis may be thought of as its principle axis and the term "horizontal" refers to the plane orthogonal to this axis.

"Front" should be understood to be with reference to a horizontal plane and to be towards the spray aperture and "rear" away there from.

Aerosol actuators that function by use of an actuator button that has a lateral movement element are prone to exert lateral pressure, either directly or indirectly, upon the valve, in particular the valve stem, of the aerosol container to which they need to be attached. Whilst this is perfectly acceptable for tilt valves, valves that operate by being pressed downwards can be damaged by such lateral pressure and it is desirable to avoid this happening. The present invention is most advantageously used with valves that operate by being pressed downwards.

In addition, it is desirably that aerosol actuators are not able to cause premature discharge of the contents of the dispenser.

The present invention addresses the above desires by providing an actuator that has a distinct first slide movement of an actuator button that puts it into an orientation in which a second depression movement causes release of the contents of the associated dispenser. By keeping these movements independent, lateral force on the valve stem is minimised and a means for avoiding premature discharge is provided.

In preferred embodiments, the slide movement of the actuator button does not have a return mechanism; that is to say, once the actuator button has been slid to its operational position, it stays there. This feature has the benefit of avoiding the need for the button to be slid forward to be operational on subsequent uses of the dispenser.

The avoidance of premature discharge is enhanced by setting a suitable minimum force for the first slide movement of the actuator button, which moves it from its inoperable position to its operable position. This force is at least 5N, preferably at least 10N, and more preferably at least 15N. The higher forces mentioned are particularly suitable for avoiding accidental discharge during assembly of the dispenser.

Lateral force on the valve stem is further minimised by having it pass through a gap or aperture in a fixed platform, the gap or aperture typically being close-fitting or snug. The fixed platform is the top wall of the over-cap of the actuator.

It is particularly important that lateral movement of the spray channel is restricted in the direction in which the actuator button is operated, which is typically in a direction towards and away from the spray aperture.

The width of the spray channel in a front-back direction, at the point where it passes through the gap, typically fills at least 90%, more typically at least 95%, and most preferably at least 98% of the width of the gap in the front-back direction at said point.

The gap in the top wall is preferably an aperture that completely surrounds the spray channel. Preferably the aperture has a circular cross-section. When the gap in the top wall is an aperture of circular cross-section, the cross-sectional area of the spray channel at the point where it passes through the aperture typically fills at least 95%, more typically at least 97%, and most preferably at least 99% of the cross-sectional area of the aperture at said point.

The "point" where spray channel passes through the gap or aperture should be understood to relate to the actuator in its "at rest" condition and, preferably, also to relate to the actuator when the spray channel is in its fully depressed condition.

In certain embodiments of the invention, rotational movement of the spray channel is also restricted. Such embodiments tend to have desirably additional robustness of operation.

In preferred embodiments of the present invention, the actuator button is associated with the top wall of the over-cap. In this position, the actuator has particular good ergonomics, that is to say, ease of use.

When the actuator button is associated with the top wall of the over-cap, it preferable that the movement of the actuator button from its first position to its second is in a direction towards the spray aperture.

The invention is particularly suitable for use with actuators having an angled actuator button, more particularly when located on an angled segment of the top wall of the over-cap supporting said actuator button. The angled segment of the top wall of the over-cap is preferably angled upwards at from 10° to 50° from the horizontal and more preferably at from 25° to 40° from the horizontal.

The keel normally depends from the finger pad in a central zone. It desirably has a wedge-shaped lower surface in profile, tapering from rear to front, i.e., is deeper at the back.

In preferred embodiments, the keel is prevented from pressing down onto the spray channel when the button is in its inoperative position by a projection that depends from the finger pad of the actuator button and interacts with a projection that rises from the top face of the top wall. Preferably there are two sets of such projections.

In more preferred embodiments, the dependent projection or projections mentioned in the preceding paragraph is/are able to slide downwardly past the projection or projections that rises/rise from the top face of the top wall when the actuator button is in its operative position.

In preferred embodiments, the over-cap is lockable into place on top of the aerosol container. This may be achieved by means of beading around the bottom inside edge of the over-cap and an associated groove towards the top of the aerosol container. By having the over-cap "locked" into place on top of the aerosol container, operational robustness is improved.

The spray channel used in accordance with the present invention is in fluid connection with the valve of the container with which the actuator is used. It typically comprises two segments that are in fluid connection with each other and with the valve. Typically the spray channel has a vertical segment designed to fit on top of the valve stem of the valve at the top of the aerosol container with which the actuator is used. In operation, it is normal for the keel to bear down upon the top of this vertical segment.

The spray channel typically comprises a vertical segment and a segment at an angle to said vertical segment, the two segments being in fluid connection. The angle between the sections is typically from 100° to 130° and preferably from 110° to 120°. The features mentioned in this paragraph work in conjunction with the top wall of the over-cap having an angled segment (vide supra) to aid the ergonomics of use of the actuator.

The actuator is typically made of plastic and most commonly by a method involving injection moulding. The spray channel and over-cap may be made of polypropylene. The majority of the actuator button may be prepared from an acetal copolymer; however, the top surface of the actuator button is preferably made of a thermoplastic elastomer in order to give increased grip.

The aerosol container for use with the actuator preferably contains a cosmetic composition for application to the surface of the human body. With such use and such compositions the ergonomic and robustness benefits of the present invention are particularly advantageous.

The container for use with the actuator is typically made of tin-plate or aluminium.

SPECIFIC EMBODIMENT

The features described with reference to the following specific embodiment may be incorporated independently into the generic description given above and/or as given in the claims.

Figure 1:
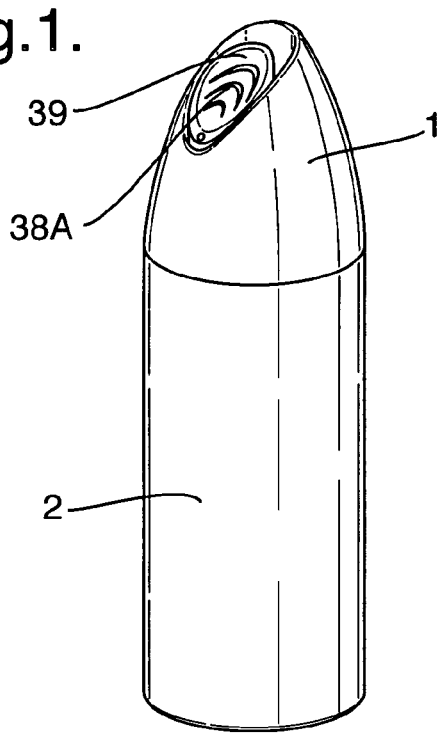
FIG. 1 is a rear/side view of the actuator (1) in place on top of a typical aerosol container (2).
Figure 2:
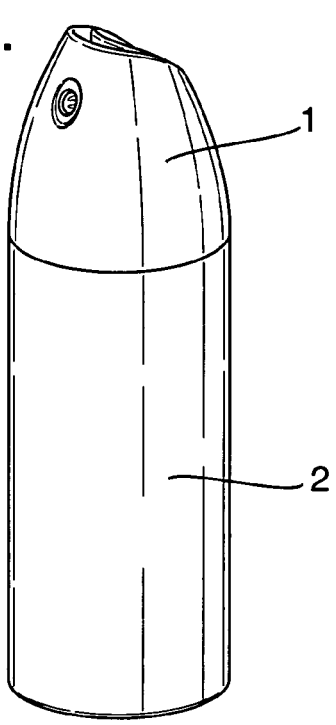
FIG. 2 is a front/side view of the actuator (1) in place on top of a typical aerosol container (2).

The actuator (1) is composed of three components: a cup-shaped over-cap (3), a spray channel (4), and actuator button (5).

The over-cap (3) and features thereof are illustrated in FIGS. 4 to 12. The over-cap (3) has a circular cross-section, defined by a side-wall (6), the diameter of the over-cap (3) decreasing towards its upper end. The side-wall (6) defines an oval spray aperture (7) which is to be considered to be at the front of the actuator (1). The oval spray aperture (7) has its short axis in the horizontal direction and is located towards the upper end of the side-wall (6).

Projecting inwardly from the side-wall (6) on either side of the spray aperture (7) are two support wings (8). These support wings (8) are thin walls extending from the top of the side-wall (6) to a point approximately half way down its length. From the side of each of the support wings (8) facing the spray aperture (7) there projects a spray channel guide wall (9). These spray channel guide walls (9) are in a vertical plane orthogonal to the front-back axis (A-A) of the actuator (1). They extend from the support wing (8) towards one another in the vicinity of the spray aperture (7). The spray channel guide walls (9) terminate leaving a gap between them that is always slightly greater than the short axis of the oval spray aperture (7).

Figure 3:
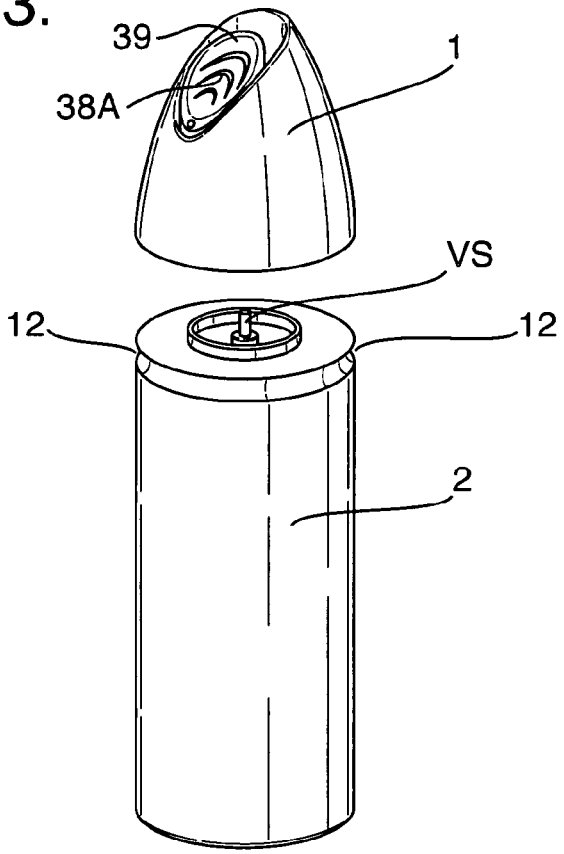
FIG. 3 is an exploded rear/side view of the actuator (1) together and a typical aerosol container (2) upon which is sits.
Figure 4:
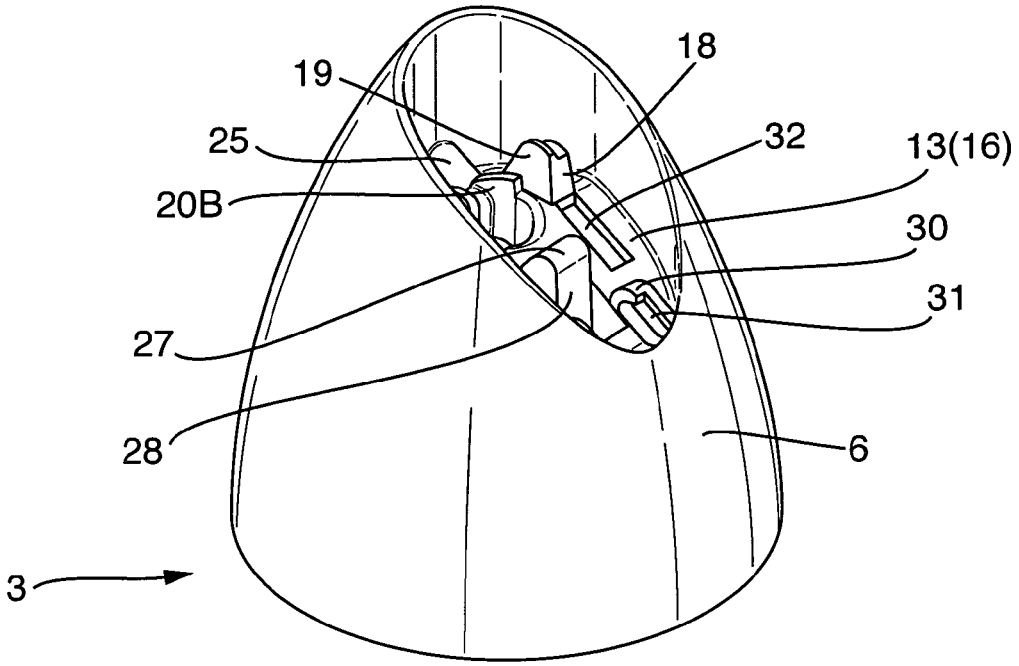
FIG. 4 is a rear/side/top view of the over-cap (3).
Figure 5:
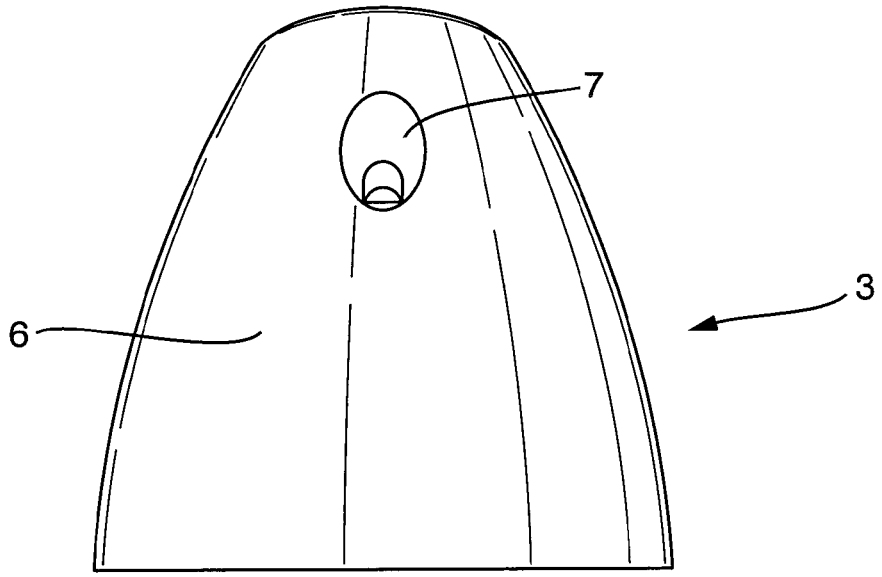
FIG. 5 is a front view of the over-cap (3).
Figure 6:
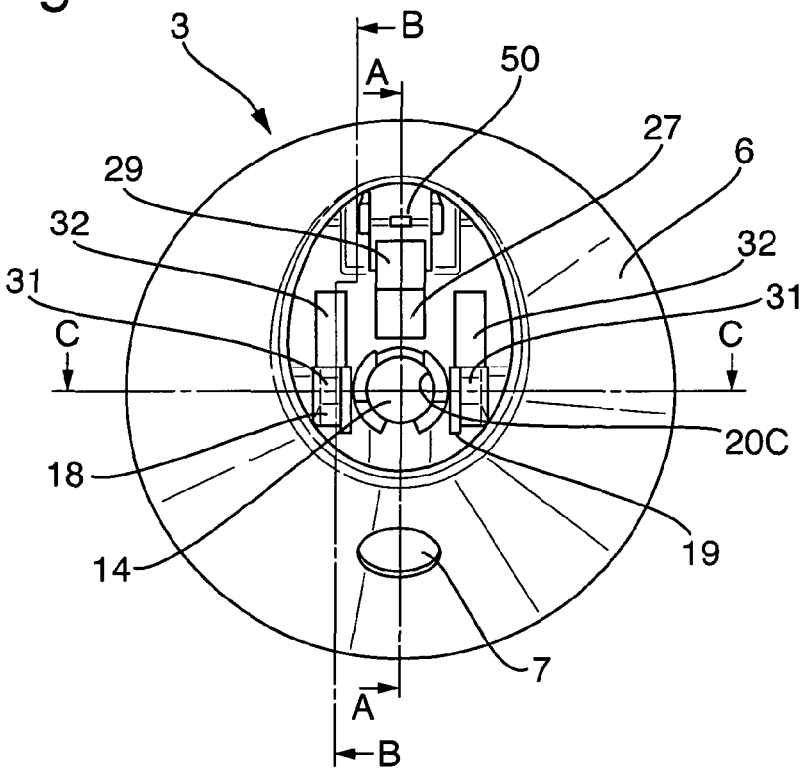
FIG. 6 is a top view of the over-cap (3) with section lines A-A, B-B, and C-C indicated.
Figure 7:
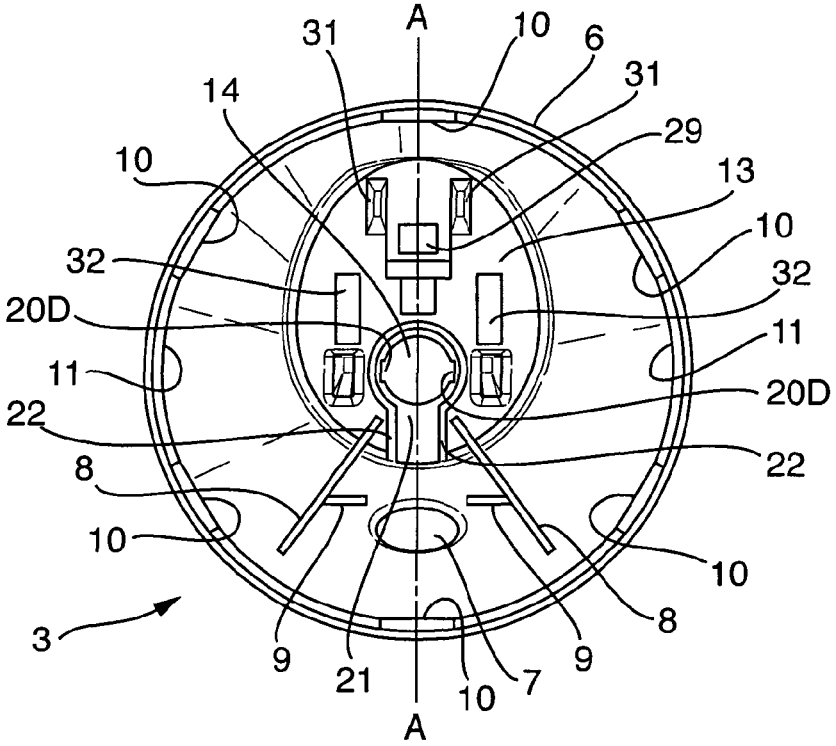
FIG. 7 is a bottom view of the over-cap (3).
Figure 8:
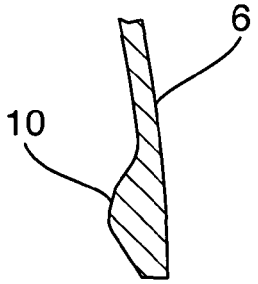
FIGS. 8 and 9 are sections across the beading (10 and 11, respectively) at the bottom of the over-cap (3).
Figure 9:
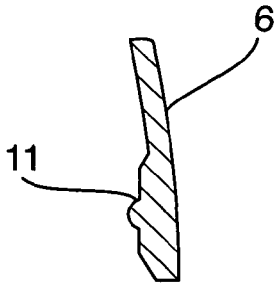
Figure 10:
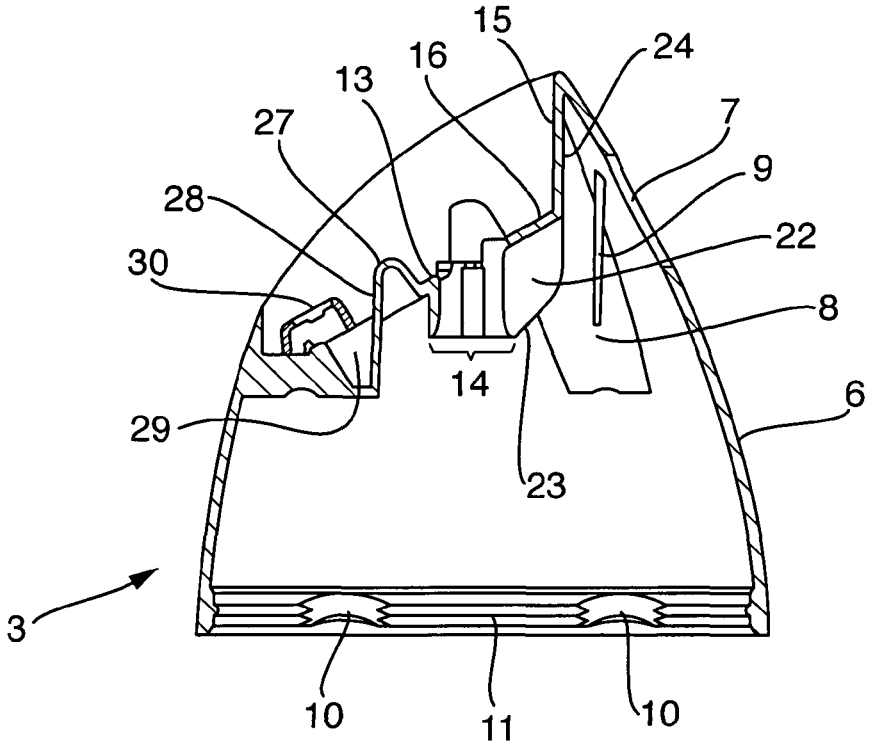
FIG. 10 is a section through the over-cap (3) along A-A.
Figure 11:
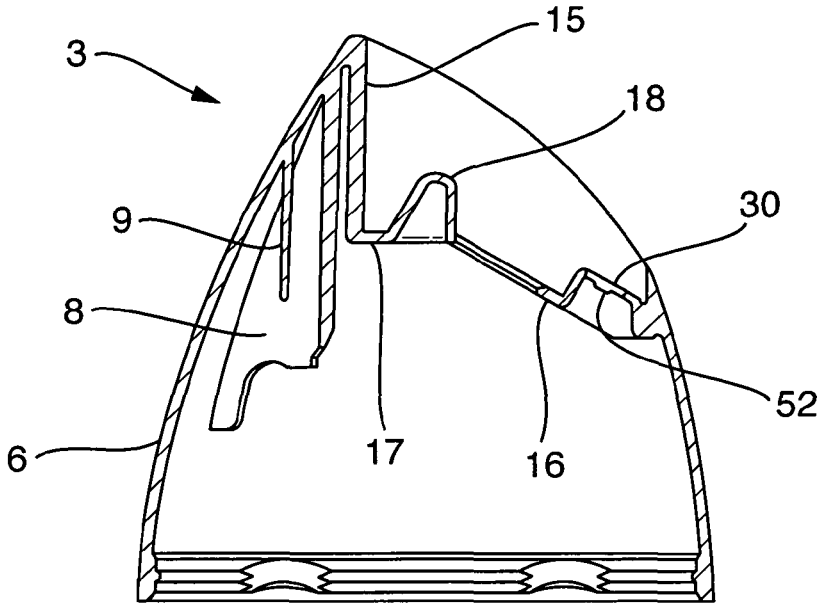
FIG. 11 is a section through the over-cap (3) along B-B.
Figure 12:
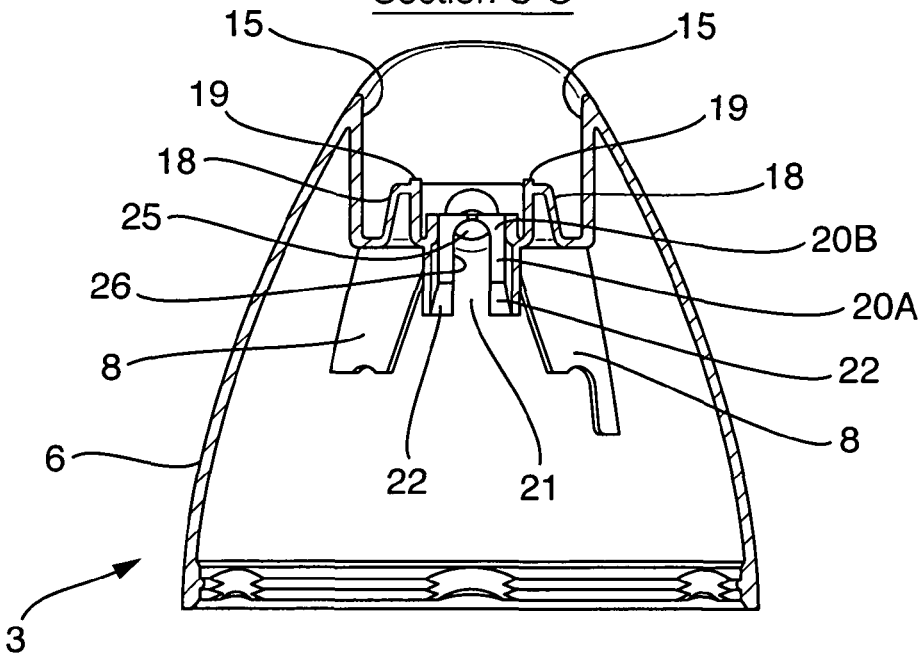
FIG. 12 is a section through the over-cap (3) along C-C.

At the bottom of the side-wall (6) there is beading (10 and 11) intended to enable the over-cap (3) to snap lock onto the top of an aerosol container (1). The beading consists of six smooth beads (10) equally distributed around the bottom inner surface of the side-wall (6) and interspersed by corrugated beading (11). Detailed cross-sections of the beading (10 and 11) is illustrated in FIGS. 8 and 9 respectively. The beading snap-fits into an indentation (12) around the top of the aerosol container 1 (see FIG. 3).

The over-cap (3) also has a top wall (13) defining an aperture (14); the aperture being intended to accommodate a segment of the spray channel (4) (vide infra). The top wall (13) is linked to the side-wall (6) by an inner wall (15) that varies in height from front to back, being relatively high at the front and decreasing towards the back.

The top wall (13) has a major segment (16) that is angled upwards towards the front of the actuator at an angle of approximately 32° from the horizontal and a minor segment (17) that is approximately horizontal. (See FIG. 11). The minor segment (17) is present at the front end of the top wall (13). The aperture (14) in the top-wall (13) is located centrally where the major (16) and minor (17) segments join, but is largely defined by the latter.

On either side of the aperture (14), in a directional orthogonal to the direction of movement of the actuator button (5), two projections (18) rise from the minor segment (17) of the top wall (13). The projections (18) each have raised ridge (19) on their side adjacent to the aperture (14).

A largely circular aperture wall (20A and 20B) lines the aperture (14) and both depends from and rises from the top wall (13) in a vertical direction. (See FIG. 12). The lower segment (20A) depending from the top wall (13) is longer than the upper segment (20B) rising from the top wall (13). The lower segment (20A) depending from the top wall (13) has a gap (21) at its front, parallel further walls (22) extending from the edges of the gap (21) towards the spray aperture (7). These parallel further walls (22) have lower edges (23) that slope upwards in the direction of the spray aperture (7). The parallel further walls (22) terminate level with the outer edge (24) of the inner wall (15).

The upper segment (20B) of the aperture wall that rises from the top wall (13) is abutted by the aforementioned projections (18) that also rise from the top wall (13). From the front of upper segment (20B), there extends a raised vault (25), linking upper segment (20B) to the inner wall (15) and bridging a "gap" in the minor segment (17) of the top-wall (13) and the upper segment (20B) of the aperture wall. The raised vault (25) is domed at its top and its inner faces (26) are contiguous with the inner faces of the parallel further walls (22) extending from the edges of the gap (21) in the lower segment (20A) of the aperture wall depending from the top wall (13). The raised vault (25) is designed to accommodate a segment of the spray channel (4) (vide infra).

The inner face (20C) of the largely circular aperture wall (20A and 20B) is contiguous and has vertical recessions (20D) on either side aligned with the two projections (18) that rise from the top wall (13) on either side of the aperture (14).

From the major segment (16) of the top wall (13), a central projection (27) rises and has a rear face (28) that extends through a gap (29) in the top wall (13). This extensive rear face (28) forms a substantial bearing wall and will be referred to as such subsequently.

Towards the back of the major segment (16) of the top wall (13) are hinge housings (30). These are intended for restraining hinge segments of the actuator button (5) (vide infra). The housings (30) sit over parallel slits (31) in the top wall (13) that extend backwards under the hinge housings (30)—i.e. in the direction away from that in which the actuator button (5) is pushed. The housings (30) are later described in further detail with reference to FIG. 16.

Towards the back of the major segment (16) of the top wall (13) are hinge housings (30). These are intended for restraining hinge segments of the actuator button (5) (vide infra). The housings (30) sit over parallel slits (31) in the top wall (13) that extend backwards under the hinge housings (30)—i.e. in the direction away from that in which the actuator button (5) is pushed. The housings (30) are later described in further detail with reference to FIG. 16.

Two further parallel slits (32) are present in the major segment (16) of the top wall (13). These further parallel slits (32) also run from front to back and are located on either side of the central projection (27), extending from immediately behind the projections (18) that rise from the top wall (13) to a point level with the rear face (28) of central projection (27).

Figure 13:
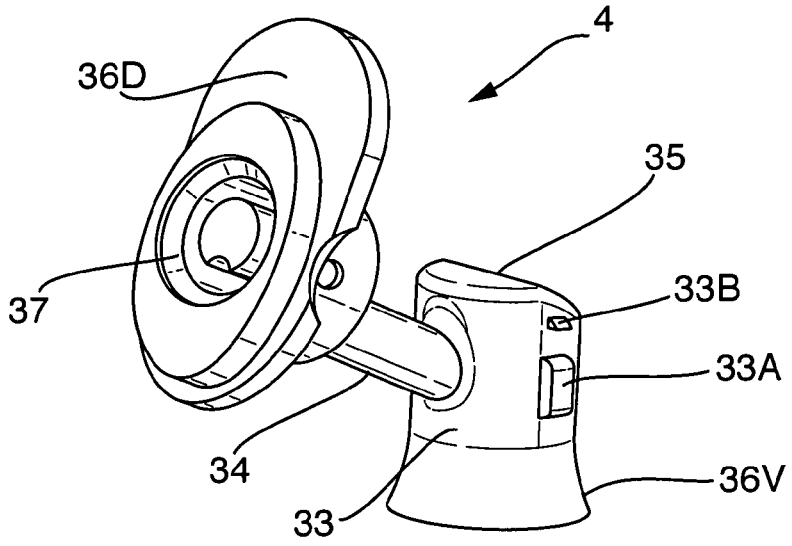
FIG. 13 is a front/side view of the spray channel (4).

The spray channel (4) is illustrated in FIG. 13. It is comprised of a vertical segment (33) and a segment (34) at an angle of approximately 114° to the vertical segment (34), i.e., 24° from the horizontal. The vertical segment (33) and the angled segment (34) are in fluid connection.

The vertical segment (33) of the spray channel (4) is designed to fit onto the valve stem (VS) of an aerosol container (1) (see FIG. 3) and is flared at its base (36V) to aid said fitting. The vertical segment (33) of the spray channel (4) is also designed to fit snugly within the aperture (14) in the top wall (13) of the over-cap (3) (vide supra). In this manner, lateral movement of the spray channel (4) is restricted. The vertical segment (33) of the spray channel (4) has a resilient area (35) at its top upon which a segment of the actuator button (5) presses when the actuator (1) is operated.

The vertical segment (33) of the spray channel (4) has a vertically orientated oblong block (33A) projecting from either of its sides, i.e., in a directional orthogonal to the direction of movement of the actuator button (5). These oblong blocks (33A) are designed to be able to slide within the vertical recessions (20D) in the inner face (20C) of the largely circular aperture wall (20A and 20B). By such means, rotational movement of the spray channel (4) is restricted.

The vertical segment (33) of the spray channel (4) has two small retaining clips (33B), each present a little way above the oblong blocks (33A) on either of its side. These clips (33B) serve to hold the spray channel (4) in place during manufacture and snap out of the way on first use of the actuator (1).

The angled segment (34) of the spray channel (4) is narrower than the vertical segment (33), both internally and externally. The angled segment (34) leads from the top of the vertical segment (33) towards to the spray aperture (7). At the spray aperture end of the angled segment (34), there is an oval disc (36D), designed to fit immediately behind the oval spray aperture (7) and leave no gap visible from the outside at any time. There is also a conventional swirl chamber (37) at the end of the angled segment (34), designed to improve spray quality.

Figure 14:
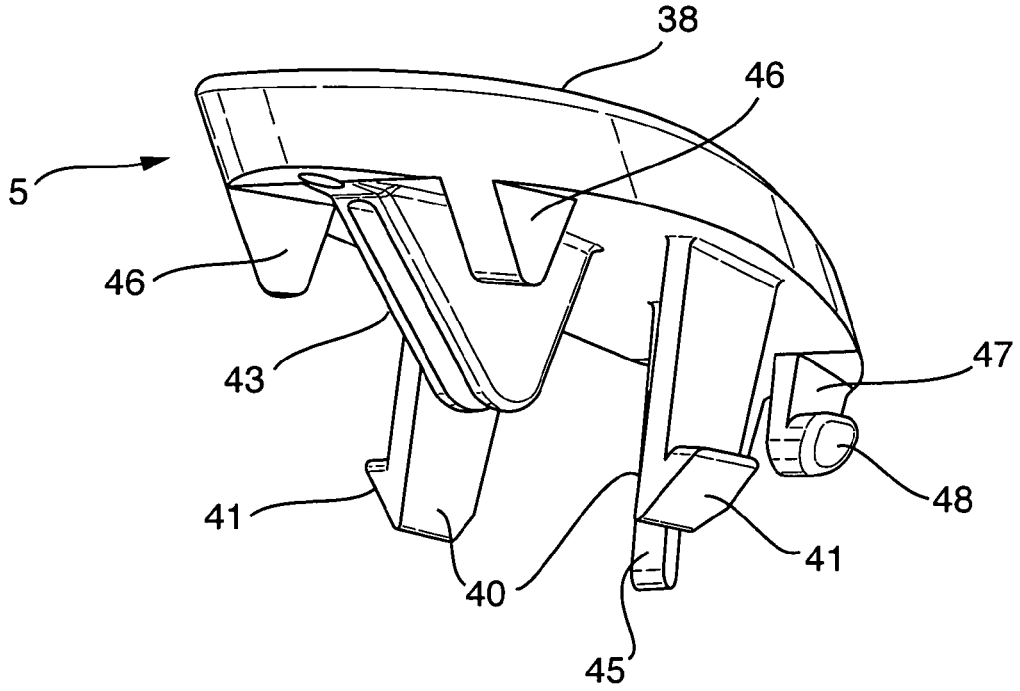
FIG. 14 is a front/side view of the actuator button (5) from slightly underneath.

The actuator button (5) is illustrated in FIG. 14. It is comprised of a finger pad (38) and various features dependent therefrom. The finger pad (38) is longer in the front-back direction, i.e. the direction in which it is designed to slide. The finger pad is designed to sit on the top wall (13) of the over-cap (3). The finger pad (38) curves upwards at its front end (39) in order to increase ergonomics of use. There are also curved projections (38A) on its top surface for this same purpose. (See FIGS. 1 and 3 for these features).

Vertically dependent from the finger pad (38) are two orientation clips (40) that are designed to pass through the two further parallel slits (32) that are present in the major segment (16) of the top wall (13) located on either side of the central projection (27). The clips (40) have outwardly facing wedges (41) that aid their insertion into the slits (32), the clips (40) being temporarily bent inwards when this is done. When the actuator button (5) is moved forwards from its first position to its second, the retaining clips (40) slide forwards within their respective slits (32).

Depending from the finger pad (38) along its central front-back axis is a keel-shaped structure (43). Said structure slopes outwards from the lower side of the finger pad (38) near its front end and terminates approximately half way along the length of the finger pad (38). The lowest part (44) of the keel-shaped structure (43) is designed to press down upon the resilient area (35) at the top of the vertical segment (33) of the actuator button (5) when the actuator (1) is operated.

From the front of the finger pad (38) there depend two projections (46) that are designed to interact with the two projections (18) that rise from the minor segment (17) of the top wall (13) of the over-cap (3). When the actuator button (5) is pushed forwards, the lower part of the projections (46) depending from the finger pad (38) slide along the top part of the projections (18) that rise the top wall (13) of the over-cap (3) until said depending projections (46) have gone past said rising projections (18). The raised ridges (19) on the projections (18) rising from the top wall (13) of the over-cap (3) serve to guide the projections (46) depending from the finger pad (38) during this process. When said depending projections (46) have gone past said rising projections (18) the actuator button (5) may be depressed.

From the rear of the finger pad (38) there depend two struts (47) bearing hinge joints (48) that are designed to fit into the hinge housings (30) located towards the back of the major segment (16) of the top wall (13) of the over-cap (3).

Also from the rear of the finger pad (38) there depends a tensioning strut (45). This interacts with the rear face (28) of the central projection (27) of the over-cap (3) when it has been slid forwards. The tensioning strut (45) serves to reduces the looseness of the over-cap (3) when its second position and thereby avoids any rattling thereof.

Figure 15:
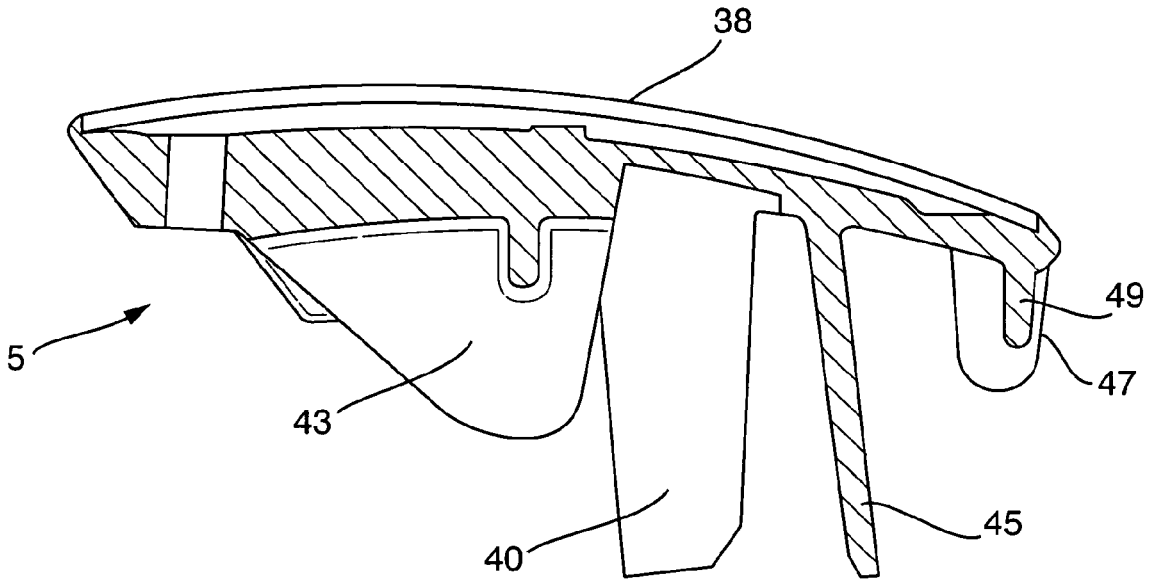
FIG. 15 is a longitudinal section through the actuator button (5).

Also from the rear of the finger pad (38) there depends a restraining clip (49) (see FIG. 15). This interacts with the restraining clip (50) (see FIGS. 6 and 16) rising upwardly from the top surface of the over-cap (3) and can help to provide resistance to the forward movement of the over-cap (3). It may also serve to resist any movement of the over-cap (3) back to its first position.

Figure 16:
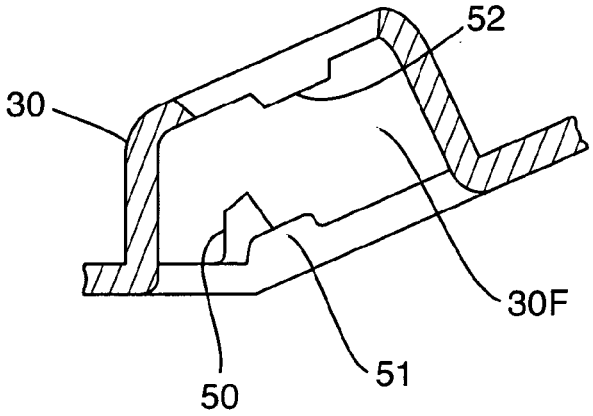
FIG. 16 is a detailed section through one of the hinge housings (30).

FIG. 16 is a detailed projection through one of the hinge housings (30). In this illustration, the front the actuator is towards the right. The hinge housing (30) has two internal beads (51) and (52) that reduce the height of housing and provide resistance to the movement of the hinge joints (48) and the associated over-cap (3) from their first position to their second. They may also serve to resist any movement of the hinge joints (48) and the associated over-cap (3) back to their first position.

FIG. 16 illustrates the restraining clip (50) rising upwardly from the top surface of the over-cap (3) (vide supra).

When the actuator button (5) is slid forward from its first position to its second, the projections (46) depending from the front of the finger pad (38) ride along the projections (18) that rise from the minor segment (17) of the top wall (13) of the over-cap (3). Simultaneous to this, the two orientation clips (40) depending from the finger pad slide forward within the two parallel slits (32) that are present in the major segment (16) of the top wall (13) located on either side of the central projection (27) and the hinge joints (48) depending from the rear of the finger pad (38) move within their housings (31) as described in further detail with reference to FIG. 16.

When the projections (46) depending from the front of the finger pad (38) have slid passed the projections (18) that rise from the minor segment (17) of the top wall (13), the actuator button (5) is able to be depressed. At this time, the hinge joints (48) depending from the rear of the finger pad (38) have moved into the front part (30F) of their housings (30) (vide infra). When the finger pad (38) is subsequently depressed, the keel-shaped structure (43) dependent therefrom bears down upon the resilient area (35) at the top of the vertical segment (33) of the spray channel (4). This causes the spray channel (4) to bear down upon the valve stem (VS) of the container (1) upon which it sits, thereby opening the valve and allowing discharge of the product within the container (1). During the depression of the vertical segment (33) of the spray channel (4), the angled segment (34) of the spray channel (4) slides downwards within the vault (25) that links the upper segment (20B) of the aperture wall to the inner wall (15) and the oval disc (36) at the end of the spray channel (4) slides downwards immediately behind the oval spray aperture (7).

When pressure is removed from the actuator button (5), the spring associated with the valve stem (VS) of the container (1) forces the spray channel (4) upwards.

The invention claimed is:

1. An actuator for a hand-held aerosol container having a top fitted centrally with a dispensing valve and having contents to be dispensed, said actuator comprising:

(i) a cup-shaped over-cap (ii) a spray channel and (iii) an actuator button, wherein:

the over-cap is attachable to the container and comprises a sidewall defining a spray aperture through which a spray can be directed and a top wall defining a gap through which the spray channel passes, said gap restricting lateral movement of the spray channel, the top wall having a top face and a projection that rises from said top face;

the spray channel is adapted to spray through the spray aperture in the sidewall of the over-cap;

the actuator button interacts with the top wall of the over-cap and comprises a finger pad from which a keel depends; and wherein when the container is associated with the actuator, the spray channel is in fluid connection with the valve and actuation requires a first slide movement of the button and an independent second depression movement of the button, the keel dependent from the finger pad of the button being able to press down onto the spray channel and the spray channel onto the valve after the first slide movement of the button, but not before;

characterised in that:

the actuator button has a distinct first slide movement that puts the button into an orientation in which a second depression movement causes release of the contents of the associated_ container;

the keel is prevented from pressing down onto the spray channel before the first slide movement of the button by a projection that depends from the finger pad of the actuator button and interacts with the projection that rises from the top face of the top wall, said projection depending from the finger pad being able to slide downwardly past the projection that rises from the top face of the top wall after the first slide movement of the actuator button;

and in that the force required for the first slide movement of the actuator button is at least 5N.

2. An actuator according to claim 1, wherein the first slide movement of the button is in a direction towards the spray aperture.

3. An actuator according to claim 1, wherein there are two projections depending from the finger pad of the actuator button independently interacting with two projections that rises from the top face of the top wall on opposite sides of the aperture in the top wall.

4. An actuator according to claim 1, wherein the gap through which the spray channel passes is an aperture that completely surrounds the spray channel.

5. An actuator according to claim 1, wherein the spray channel comprises a vertical segment upon the top of which the keel dependent from the finger pad of the actuator button is able to press following the first slide movement of the actuator button.

6. An actuator according to claim 5, wherein the spray channel comprises a segment contiguous with the vertical segment that leads from the vertical segment towards the spray aperture and is angled upwards at from 5° to 45° from the horizontal.

7. An actuator according to claim 1, wherein the top wall of the over-cap has a segment that is angled upwards at from 10° to 50° from the horizontal.

8. An actuator according to claim 1, wherein the first slide movement of the actuator button requires a force of at least 10N.

9. An actuator according to claim 1, wherein the actuator button lacks a mechanism for returning the button to a first position in which the keel is prevented from pressing down onto the spray channel.

* * * * *